US005957784A

United States Patent [19]

Asakura et al.

[11] Patent Number: 5,957,784

[45] Date of Patent: Sep. 28, 1999

[54] MULTI-PIECE SOLID GOLF BALL

[75] Inventors: Takeshi Asakura; Keiji Moriyama, both of Shirakawa; Hidenori Hiraoka, Akashi, all of Japan

[73] Assignee: Sumitomo Rubber Industries, LTD., Hyogo-ken, Japan

[21] Appl. No.: 08/911,939

[22] Filed: Aug. 15, 1997

[30] Foreign Application Priority Data

Aug. 15, 1996 [JP] Japan ..... 8-215730

[51] Int. Cl.[6] ..... A63B 37/06; A63B 37/12

[52] U.S. Cl. ..... 473/374; 473/378

[58] Field of Search ..... 473/363, 374, 473/373, 376, 378

[56] References Cited

U.S. PATENT DOCUMENTS 5,704,853 1/1998 Maruko et al. ..... 473/363
5,759,676 6/1998 Cavallaro et al. ..... 473/374 X

FOREIGN PATENT DOCUMENTS 2168059 6/1986 United Kingdom .
2306118 4/1997 United Kingdom .

*Primary Examiner*—George J. Marlo
*Attorney, Agent, or Firm*—Birch, Stewart, Kolasch & Birch, LLP

[57] ABSTRACT

A multi piece solid golf ball comprising:

a core (1), at least one intermediate layer (2) formed on the core (1) and a cover (3) covering the intermediate layer (2) consists essentially of (I) 100 to 10% by weight of a polyurthane thermoplastic elastomer and (ii) o to 90% by weight of an ionomer of ethylene-(meth) acrylic acid copolymer and having a flexural modiolus of 500 to 5,000 Kgf/cm$^2$, and the cover (3) is formed from an ionomer resin of ethylene-(meth)acrylic copolymer and has a shore D hardness of 50 to 75 and the core (1) has a press deformation of 3.0 to 6.0 mm, the press deformation being obtained by applying an initial load of 10 Kg on the core to measure a deformation of core (Xmm) and then applying a final load of 130 Kg on the core to measure a deformation of core (Ymm), followed by calculating (Y−X)mm, which is the press deformation.

11 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball having excellent shot feel at the time of hitting without deteriorating the inherent long flight distance characteristics of solid golf balls.

BACKGROUND OF THE INVENTION

Many golf balls are commercially available, but they are typically classified into two piece solid golf ball and thread wound golf balls. The two piece solid golf ball consists of a solid core of molded rubber material and a cover of a thermoplastic resin (e.g. ionomer resin) on the solid core. The thread wound golf ball consists of a solid or liquid center, a thread wound layer formed on the center and a cover of an ionomer resin balata or the like on the thread wound layer.

The two piece solid golf ball, when compared with the thread wound golf ball, has better durability, flight performance and longer flight distance because of a larger initial velocity upon hitting. The two piece solid golf ball is generally approved or employed by many golfers, especially amateur golfers. On the other hand, the two piece solid golf ball has poor shot feel at the time of hitting and poor controllability at approach shot because of a low spin rate. The thread wound golf ball has better shot feel and better controllability during an approach shot than the two piece solid golf ball, but also has less flight distance and less durability.

An attempt was made to improve the shot feel of the two piece solid golf ball, by preparing a soft type two piece solid golf ball having a softer core. However the soft core adversely affects on impact resilience, thus resulting in the reduction of flight distance and the deterioration of durability.

Then, it was proposed that an intermediate layer be placed between the core and the cover of the two piece solid golf ball to keep the balance between flight performance and shot feel at the time of hitting. For example, Japanese Kokai Publication Hei 4 (1992)-244174 taught a mixture of a block copolymer of polyamide and an ionomer resin as the intermediate layer. This golf ball, however, showed relatively poor impact resilience and poor flight distance. Japanese Kokai Publication Hei 6 (1994)-218078 taught that the intermediate layer is made from an ionomer resin and the cover is formed from a soft elastomer, such as rubber or balata. However, the use of ionomer resin in the intermediate layer adversely effects the shot feel at the time of hitting. In Japanese Kokai Publication Hei 6 (1994)-142228, a use of a mixture of a polyether-ester thermoplastic elastomer and an ethylene-(meth)acrylic acid copolymer ionomer is suggested. This does not result in shot feel and impact resilience.

Japanese Kokai Publication Hei 7 (1995)-171863 suggest that a mixture of a polyamide and an ionomer resin is used as the intermediate layer. However, the resulting golf ball has the benefit of high hardness, but poor impact resilience and therefore is not sufficient for keeping the balance between flight distance and shot feel at the time of hitting.

OBJECTS OF THE INVENTION

The present invention provides a multi-piece solid golf ball having excellent shot feel at the time of hitting without deteriorating long flight distance which is an inherent characteristic of solid golf balls.

This object as well as other objects and advantages of the present invention will become apparent to those skilled in the art from the following description with reference to the accompanying drawing.

SUMMARY OF THE INVENTION

Figure 1:
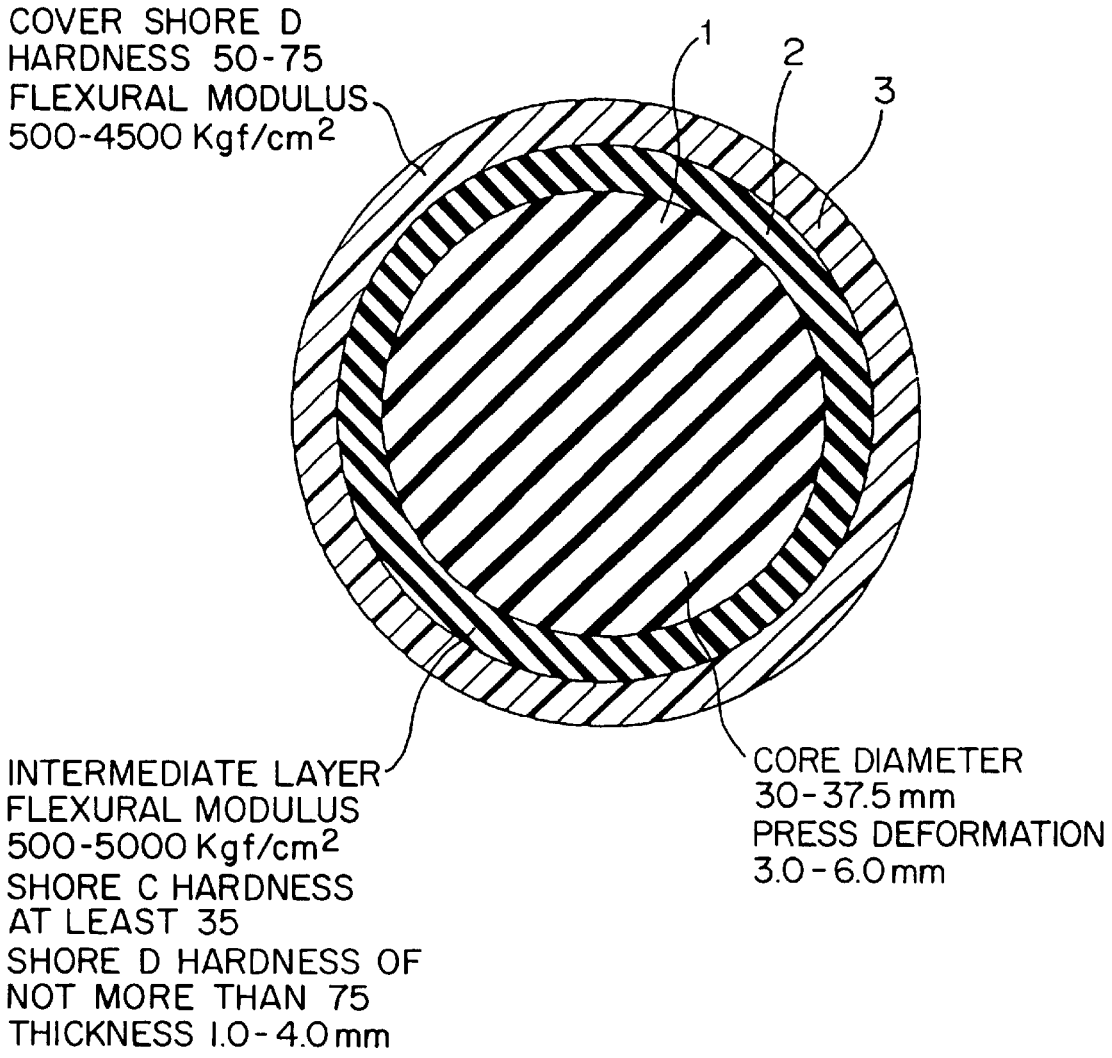
FIG. 1 is a schematic cross section illustrating one embodiment of the multi-piece solid golf ball of the present invention.

The present invention provides a multi-piece solid golf ball which comprises a core (1), at least one intermediate layer (2) formed on the core (1) and a cover (3) covering the intermediate layer (2), wherein at least one layer of the intermediate layer (2) is essentially consisting of (i) 100 to 10 % by weight of a polyurethane thermoplastic elastomer and (ii) 0 to 90 % by weight of an ionomer of ethylene-(meth)acrylic acid copolymer and having a flexural modulus of 1,500 to 5,000 Kgf/cm$^2$, and the cover (3) is formed from an ionomer resin of ethylene-(meth)acrylic copolymer and has a shore D hardness of 50 to 75.

DETAILED DESCRIPTION OF THE INVENTION

The present invention will be explained with reference to FIG. 1. FIG. 1 shows a cross-sectional view of one embodiment of the multi-piece solid golf ball of the present invention. The multi-piece solid golf ball of the present invention is composed of a core (1), and an intermediate layer (2) formed on the core (1) and a cover (3) formed on the intermediate layer (2). The intermediate layer (2) may be formed from two or more layers in which at least one layer is formed from a mixture essentially consisting of a polyurethane elastomer and an ionomer of an ethylene-(meth) acrylic acid copolymer. The layer(s) other than the layer of the specific mixture may be formed from the material which has been used for golf balls, such as vulcanized rubber or thermoplastic resin (e.g. ionomer resin, polyamide resin etc.) Preferably, the intermediate layer is composed of one layer of a polyurethane/ethylene-(meth)acrylic acid copolymer mixture. Hereinafter, the preferred embodiment in which the intermediate layer is composed of one layer and is formed from the specific mixture is described.

The core (1) is obtained by vulcanizing a rubber composition at conditions which have been used to form a solid core for golf balls. The rubber composition may be composed of a base rubber, a crosslinking agent, a metal salt of unsaturated carboxylic acid and optionally a filler and antioxidant or the like. The base rubber may be a natural rubber and/or a synthetic rubber, especially a high-cis polybutadiene rubber having at least 40% of cis-1,4 bond, preferably at least 80% of cis-1,4 bond. The base rubber may contain other rubbers, such as polyisoprene rubber, styrene-butadiene rubber, ethylene-propylene-diene rubber (EPDM) or the like.

The crosslinking agent includes an organic peroxide, such as dicumyl peroxide or t-butyl peroxide. Preferred is dicumyl peroxide. The crosslinking agent may be contained in the rubber composition in an amount of 0.3 to 5.0 parts by weight, preferably 0.5 to 3.0 parts by weight based on 100 parts by weight of the base rubber. Amounts of less than 0.3 parts by weight soften the core too much and reduce impact resilience, thus deteriorating flight distance. Amounts of more than 5.0 parts by weight harden the core too much and thus adversely effect the shot feel.

The metal salt of unsaturated carboxylic acid acts as co-crosslinking agent and includes mono- or di-valent metal salt of α,β-unsaturated carboxylic acid having 3 to 8 carbon atoms, such as acrylic acid, methacrylic acid and the like. Examples of the mono- or di-valent metals include zinc, magnesium and the like. Preferred are zinc acrylate and zinc methacrylate. The metal salt of unsaturated carboxylic acid may be contained in the rubber composition in an amount of 15 to 30 parts by weight. Amounts of more than 30 parts by weight harden the core too much and deteriorate shot feel. Amounts of less than 15 parts by weight reduce impact resilience and reduce flight distance.

The filler can be any one of which have been typically used for the core of the solid golf balls and include inorganic salts, such as zinc oxide, barium sulfate, calcium carbonate or the like; metal powder having high specific gravity, such as tungsten powder, molybdenum powder or the like; and a mixture thereof. The amount of filler may vary depending upon the specific gravity of the core and its size, but generally within the range of 5 to 50 parts by weight, based on 100 parts by weight of the base rubber. Amounts of less than 5 parts by weight lighten the core too much and those of more than 50 parts by weight cause the core weigh too much.

The rubber composition for the core of the golf ball of the present invention may optionally contain an antioxidant in an amount of 0.2 to 0.5 parts by weight, based on 100 parts by weight of the base rubber. The rubber composition may optionally contain a peptizer.

The core may be generally be obtained by vulcanizing the above mentioned rubber composition in a mold at a temperature of 130 to 180° C. for 10 to 50 minutes. The resulting core preferably has a diameter of 30 to 37.5 mm, more preferably 32 to 37.5 mm. If the core has a diameter of less than 30 mm, the resulting golf ball has poor impact resilience and poor flight performance. If it has more than 37.5 mm, a thickness of the cover is too thin then the durability of the ball is deteriorated.

In the present invention, it is preferred that the core has a press deformation of 3.0 to 6.0 mm, more preferably 3.0 to 5.0 mm. The press deformation is obtained by applying an initial load of 10 Kg on the core to measure a deformation of core (X mm) and then applying a final load of 130 Kg on the core to measure a deformation of core (Y mm), followed by calculating (Y−X) mm. If the press deformation is less than 3.0 mm, the core is too hard and the shot feel of the golf ball is deteriorated. If it is more than 6.0 mm, the golf ball has poor impact resilience and reduces durability.

The intermediate layer (2) of the present invention essentially consists of (i) 100 to 10% by weight of polyurethane thermoplastic elastomer and (ii) 0 to 90% by weight of an ionomer of ethylene-(meth)acrylic acid copolymer having a flexural modulus of 1,500 to 5,000 Kgf/cm$^2$. If an amount of the polyurethane elastomer is less than 10% by weight, the characteristics of polyurethane thermoplastic elastomer, that is softness and high impact resilience, is not functioned sufficiently. In the above context, the total amount of the polyurethane thermoplastic elastomer (i) and the ionomer (ii) is 100% by weight. Accordingly, if the elastomer (i) is present 10% by weight, the ionomer (ii) is present 90% by weight. In case that the elastomer (i) is present 100% by weight, the ionomer is not formulated. The intermediate layer (2) essentially consists of the elastomer (i) and the ionomer (ii), but the wording "essentially consisting of" herein means that a small amount of the other components may be formulated into the intermediate layer (2). Examples of the other components are pigment (such as titanium oxide), filler (such as zinc oxide and barium sulfate), antioxidant, metal powder (such as tungsten powder, molybdenum powder and gold powder) and the like. The other components can be present in the intermediate layer (2) in an amount of 10 to 50 parts by weight, based on 100 parts by weight of 100 parts by weight of the mixture of the elastomer (i) and the ionomer (ii).

The ionomer of ethylene-(meth)acrylic acid copolymer is necessary to have a flexural modulus of 1,500 to 5,000 kgf/cm$^2$, preferably 2,000 to 4,000 kgf/cm$^2$. If it is less than 1,500 kgf/cm$^2$, impact resilience is poor and flight performance is also poor. If it is more than 5,000 kgf/cm$^2$, the core is too hard and the shot feel of the resulting golf ball is poor.

The intermediate layer (2) preferably has a Shore C hardness of at least 35 and a Shore D hardness of not more than 75, preferably a Shore C hardness of 40 to 80. If the Shore C hardness is less than 35, the resulting core is too soft and the impact resilience and durability are deteriorated. If the Shore D hardness is more than 75, the core is too hard and the shot feel of the resulting golf ball is poor.

The polyurethane thermoplastic elastomer (i) used in the present invention can be a polymer obtained by reacting an aromatic diisocyanate with a polyester polyol or polyether polyol. Typical examples of the polyurethane thermoplastic elastomers (i) are PANDEX T-7890N or PANDEX T-2983, both available from Dainippon Ink & Chemicals, Inc. The ionomer (ii) has a backbone of ethylene-(meth)acrylic acid copolymer which is neutralized with metal ion. The metal ion to be neutralized includes mono- and di-valent metals, for example sodium, potassium, lithium, zinc, calcium or magnesium. Typical examples of the ionomers (ii) are Hi-milan 1605 and 1706, both available from Mitsui Du Pont Polychemical Co., Ltd.; IOTEC 7010 and 8000, both available from Exxon Co. or the like. The above examples of the elastomer (i) and the ionomer (ii) are mere suggestions and therefore the present invention is not limited thereto.

The intermediate layer (2) may be formed by conventional methods which have been known to the art and used for the cover of the golf balls. For example, the resin mixture for the intermediate layer (2) is initially shaped into two half shells which encapsulate the core (1), and is then press-molded. The resin mixture for the intermediate layer (2) may be directly injection-molded on the core (1). The intermediate layer (2) preferably has a thickness of 1.0 to 4.0 mm, more preferably 1.6 to 2.3 mm. If it is less than 1.0 mm, the intermediate layer (2) does not sufficiently function and the shot feel is poor. If it is more than 4.0 mm, the core is too soft and the impact resilience is poor, thus resulting in poor flight performance.

The cover (3) is generally formed from ionomer resins which have been employed for golf balls. Typically, the ionomer resin is an ethylene-(meth)acrylic acid copolymer of which a portion of free carboxylic acid groups is neutralized with metal ion or a mixture thereof. The metal ion to be neutralized includes alkaline metal ion, such as sodium ion, potassium ion, lithium ion or the like; divalent metal ion, such as zinc ion, calcium ion, magnesium ion or the like; trivalent metal ion, such as aluminum ion, neodymium ion and the like; or a mixture thereof. Preferred metal ion is sodium ion, zinc ion or lithium ion, which effect high impact resilience and high durability. Non-limited examples of the ionomer resins are Hi-milan 1557, 1605, 1652, 105, 1706, 1707, 1855 and 1856, available from Mitsui Du Pont Polychemical Co., Ltd.; IOTEC 7010 and 8000, available from Exxon Co.; or the like.

In the present invention, the cover composition mainly contains the above ionomer resin, but if necessary, it further contains filler, such as barium sulfate; colorant, such as titanium dioxide; and other additives, such as dispersant, antioxidant, UV absorber, light stabilizer and fluorescent material or fluorescent brightener. These chemicals may be contained within an amount so as not to damage the cover of the resulting golf ball is by the presence of the chemicals. The colorant may preferably be contained in an amount of 0.1 to 0.5 parts by weight based on 100 parts by weight of the cover resin.

The cover (3) can be formed by the same methods as explained above for the intermediate layer (2). The cover (3) preferably has a Shore D hardness of 50 to 75, more preferably 55 to 70. If it has a Shore D hardness of less than 50, the resulting golf ball has poor impact resilience and poor flight distance. If it is more than 75, the resulting golf ball is too hard and shows poor shot feel. The cover (3) may preferably have a flexural modulus of 500 to 4,500 kgf/cm$^2$, more preferably 1,000 to 3,500 kgf/cm$^2$. If the cover has a flexural modulus of less than 500 kgf/cm$^2$, the resulting golf ball is too soft and shows poor impact resilience, thus effecting poor flight performance. If it is more than 4,500 kgf/cm$^2$, the resulting golf ball is too hard and shows poor shot feel.

At the time of preparing the cover molding, dimples may be optionally formed on the surface of the golf ball. Paint finishing or marking may be optionally provided after cover molding.

EXAMPLES

The following Examples and Comparative Examples further illustrate the present invention in detail but are not to be construed to limit the scope thereof.

Preparation of Cores

Two cores (I and II) for golf balls having a diameter of 35.1 mm were prepared by mixing the ingredients as shown in Table 1 and press-molded by a two stage molding condition, i.e. 140° C. for 18 minutes and 165° C. for 8 minutes. The resulting cores were subjected to a measurement of press deformation test which was conducted by applying an initial load of 10 Kg on the core to measure a deformation of core (X mm) and then applying a final load of 130 Kg on the core to measure a deformation of core (Y mm), followed by calculating (Y−X) mm. The results are shown in Table 1.

TABLE 1

| Ingredients | I (parts by wt) | II (parts by wt) |
|---|---|---|
| BR 18 *1 | 100 | 100 |
| Zinc acrylate | 26 | 24 |
| Dicumyl peroxide | 1.0 | 1.0 |
| zinc oxide | 31 | 31.6 |
| Antioxide *2 | 0.5 | 0.5 |
| Press deformation (mm) | 3.40 | 3.60 |

*1 BR 16 : Polybutadiene rubber having a cis-1,4 bond content of 96%, available from Japan Synthetic Rubber Co., Ltd.
*2 Yoshinox 425, available from Yoshitomi Pharmaceutical Co., Ltd.

Ingredients of Intermediate Layer and Cover

Formulations of intermediate layers and cover are shown in Table 2.

TABLE 2

| | Intermediate layer | | | | | Cover |
|---|---|---|---|---|---|---|
| Ingredients | A | B | C | D | E | F |
| Hi-milan 1605 *3 | — | 20 | — | — | — | 50 |
| Hi-milan 1706 *4 | — | — | — | — | — | 50 |
| PANDEX T-7890N *5 | 100 | 80 | — | — | — | — |
| PANDEX T-2983N *6 | — | — | 100 | — | — | — |
| HYTREL 4047 *7 | — | — | — | 100 | — | — |
| PEBAX 3533 *8 | — | — | — | — | 100 | — |
| Titanium oxide | — | — | — | — | — | 2 |
| Barium sulfate | — | — | — | — | — | 2 |
| Antioxidant *2 | — | — | — | — | — | 0.2 |

*3 An ionomer resin of ethylene-methacrylic acid copolymer neutralized with sodium ion, having a flexural modulus of about 3,150 kgf/cm$^2$, available from Mitsui Du Pont Polychemical Co., Ltd.
*4 An ionomer resin of ethylene-methacrylic acid copolymer neutralized with zinc ion, having a flexural modulus of about 2,650 kgf/cm$^2$, available from Mitsui Du Pont Polychemical Co., Ltd.
*5 A polyurethane thermoplastic elastomer, available from Dainippon Inc & Chemical Inc.
*6 A polyurethane thermoplastic elastomer, available from Dainippon Inc & Chemical Inc.
*7 A polyester thermoplastic elastomer, available from Toray Du Pont Co., Ltd.
*8 A polyamide thermoplastic elastomer available from ATOCHEM Co.

Examples 1 to 4 and Comparative Examples 1 to 2

An intermediate layer was formed from the intermediate layer ingredients of Table 2 by injection molding on the core obtained above and then a cover was injection-molded thereon from the cover ingredients of Table 2 to obtain a golf ball. The combination of the core, intermediate layer and cover ingredients is shown in Table 3. The golf ball was painted using a conventional paint to obtain a golf ball having a diameter of 42.75 mm. The golf ball was subjected to evaluations of ball compression, flight distance of carry as flight performance and shot feel and the results are shown in Table 3. The evaluation methods are explained as follow.

(Evaluation Method)

Ball press deformation: The evaluation was conducted by applying an initial load of 10 Kg on the ball to measure a deformation of ball (X mm) and then applying a final load of 130 Kg on the ball to measure a deformation of ball (Y mm), followed by calculating (Y−X) mm.

Flight performance of carry: A wood No. 1 club was attached to a swing robot available from True Temper Co. and a golf ball was hit at a head speed of 45 m/s to determine a flight distance of carry. The term "carry" means the distance travelled by the golf ball before bouncing.

Shot feel: 10 Professional golfers of top level actually hit 10 golf balls and evaluated shot feel by three criteria of very good, good and fairy good. Comparative Example 3 was a two piece solid golf ball which had been sold by Sumitomo Rubber Industries Ltd.

TABLE 3

| | Examples | | | | Comparative Example | | |
|---|---|---|---|---|---|---|---|
| | 1 | 2 | 3 | 4 | 1 | 2 | 3 |
| (Core) | | | | | | | |
| Ingredients | I | I | I | II | I | I | — |
| Core compression | 3.40 | 3.40 | 3.40 | 3.60 | 3.40 | 3.40 | — |
| (Intermediate layer) | | | | | | | |
| Ingredients | A | B | C | A | D | E | — |
| Thickness (mm) | 1.9 | 1.9 | 1.9 | 1.9 | 1.9 | 1.9 | — |
| (Cover) | | | | | | | |
| Ingredients | F | F | F | F | F | F | — |
| Thickness (mm) | 1.9 | 1.9 | 1.9 | 1.9 | 1.9 | 1.9 | 2.3 |
| Shore D hardness | 68 | 69 | 69 | 68 | 68 | 68 | 69 |
| (Evaluations) | | | | | | | |
| Ball press deformation (mm) | 3.10 | 3.00 | 3.00 | 3.20 | 2.95 | 3.00 | 2.80 |
| Flight performance (carry) in yard | 208.6 | 209.9 | 209.2 | 208.1 | 207.2 | 206.3 | 207.4 |
| Shot feel | Good | Good | Good | Very good | Very good | Very good | Very good |

As is apparent from the above results, the golf balls of Examples exhibit good shot feel and good flight performance. On the other hand, the golf ball of Comparative Example 1 which employed the polyester thermoplastic elastomer exhibits poor shot feel and poor flight performance, and so do the golf ball of Comparative Example 2 which employed the polyamide thermoplastic elastomer. The golf balls of Examples 1 to 4, when compared with the two piece golf ball which had been sold from Sumitomo Rubber Industries Inc., exhibits increased shot feel without degrading the flight performance.

What is claimed is:

1. A multi-piece solid golf ball, comprising:

a core (1), at least one intermediate later (2) formed on the core (1) and a cover (3) covering the intermediate layer (2), wherein at least one layer of the intermediate layer (2) consists essentially of (i) 100 to 10% by weight of a polyurethane thermoplastic elastomer and (ii) 0 to 90% by weight of an ionomer of ethylene-(meth)acrylic acid copolymer and having a flexural modulus of 500 to 5,000 Kgf/cm$^2$, and the cover (3) is formed from an ionomer resin of ethylene-(meth)acrylic copolymer and has a shore D hardness of 50 to 75 and the core (1) has a press deformation of 3.0 to 6.0 mm, the press deformation being obtained by applying an initial load of 10 Kg on the core to measure a deformation of core (X mm) and then applying a final load of 130 Kg on the core to measure a deformation of core (Y mm), followed by calculating (Y−X)mm, which is the press deformation.

2. The multi-piece solid golf ball according to claim 1 wherein the intermediate layer (2) is prepared by mixing (i) 100 to 10% by weight of a polyurethane thermoplastic elastomer and (ii) 0 to 90% by weight of an ionomer of ethylene-(meth)acrylic acid copolymer and having a flexural modulus of 1,500 to 5,000 Kgf/cm$^2$.

3. The multi-piece solid golf ball according to claim 2 wherein the core (1) is formed from vulcanized rubber.

4. The multi-piece solid golf ball according to claim 3 wherein the rubber composition comprises a base rubber, a crosslinking agent, a metal salt of an unsaturated carboxylic acid, filler and an antioxidant.

5. The multi-piece solid golf ball according to claim 4 wherein the base rubber is a high-cis polybutadiene rubber having at least 80% of cis-1,4 bond.

6. The multi-piece solid golf ball according claim 1 wherein the core has a diameter of 30 to 37.5 mm.

7. The multi-piece solid golf ball according to claim 1 wherein the total amount of the polyurethane thermoplastic elastomer (i) and the ionomer (ii) is 100% by weight.

8. The multi-piece solid golf ball according to claim 1 wherein the intermediate layer (2) has a Shore C hardness of at least 35 and a Shore D hardness of not more than 75.

9. The multi-piece solid golf ball according to claim 1 wherein the polyurethane thermoplastic elastomer (i) is a polymer obtained by reacting an aromatic diisocyanate with a polyester polyol or polyether polyol.

10. The multi-piece solid golf ball according to claim 1 wherein the intermediate layer (2) has a thickness of 1.0 to 4.0 mm.

11. The multi-piece solid golf ball according to claim 1 wherein the cover (3) has a flexural modulus of 500 to 4,500 kgf/cm$^2$.

* * * * *